US009725141B2

(12) United States Patent
Schultz, III

(10) Patent No.: US 9,725,141 B2
(45) **Date of Patent: *Aug. 8, 2017**

(54) SLIDABLE SURFBOARD FIN

(71) Applicant: Edward King Schultz, III, San Diego, CA (US)

(72) Inventor: Edward King Schultz, III, San Diego, CA (US)

(73) Assignee: Edward King Schultz, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,067

(22) Filed: Feb. 29, 2016

(65) Prior Publication Data

US 2016/0176482 A1 Jun. 23, 2016

Related U.S. Application Data

(63) Continuation of application No. 14/617,830, filed on Feb. 9, 2015, now Pat. No. 9,272,759, which is a continuation of application No. 14/054,587, filed on Oct. 15, 2013, now Pat. No. 8,951,080, which is a continuation of application No. 13/209,345, filed on Aug. 12, 2011, now Pat. No. 8,556,670.

(60) Provisional application No. 61/373,777, filed on Aug. 13, 2010.

(51) Int. Cl.
*B63B 35/79* (2006.01)

(52) U.S. Cl.
CPC ..... *B63B 35/7926* (2013.01); *B63B 35/79* (2013.01); *B63B 35/793* (2013.01)

(58) Field of Classification Search
CPC ..... B63B 35/7926; B63B 35/793
See application file for complete search history.

(56) References Cited

U.S. PATENT DOCUMENTS

| | | | | |
|---|---|---|---|---|
| 4,325,154 | A * | 4/1982 | Collum, Jr. | B63B 41/00 114/127 |
| 4,964,826 | A * | 10/1990 | Lobe | B63B 35/793 114/132 |
| 8,113,896 | B2 * | 2/2012 | Wang | B63B 35/7926 441/79 |
| 8,556,670 | B2 * | 10/2013 | Schultz, III | B63B 35/79 441/79 |
| 8,951,080 | B2 * | 2/2015 | Schultz, III | B63B 35/79 441/79 |
| 9,272,759 | B2 * | 3/2016 | Schultz, III | B63B 35/793 |
| 2010/0068956 | A1 * | 3/2010 | Anton | B63B 35/7926 441/79 |
| 2012/0040575 | A1 * | 2/2012 | Schultz, III | B63B 35/79 441/74 |

* cited by examiner

*Primary Examiner* — Edwin Swinehart
(74) *Attorney, Agent, or Firm* — Mintz Levin Cohn Ferris Glovsky and Popeo, P.C.

(57) ABSTRACT

A sliding fin for a surfboard includes a base having a planar tab with an upper flange, a large fin piece having a first indentation, and a small fin piece for mating face-to-face with the large fin piece. The second fin piece has a second indentation that forms a channel that has a cross-sectional shape corresponding to a cross-sectional shape of the planar tab and upper flange, the channel being longer than the width of the planar tab, the small fin piece being translucent to enable the planar tab in the channel to be seen, the large and small fin pieces being slidable relative to the base on the planar tab.

11 Claims, 3 Drawing Sheets

SLIDABLE SURFBOARD FIN

CROSS REFERENCE TO RELATED APPLICATIONS

This application is a continuation and claims the benefit of priority under 35 U.S.C. §120 of U.S. patent application Ser. No. 14/617,830, filed Feb. 9, 2015, entitled "SLIDABLE SURFBOARD FIN;" which is a continuation of U.S. patent application Ser. No. 14/054,587, filed Oct. 15, 2013, entitled "SLIDABLE SURFBOARD FIN" now granted as U.S. Pat. No. 8,951,080; which is a continuation of U.S. patent application Ser. No. 13/209,345, filed Aug. 12, 2011, entitled "SLIDABLE SURFBOARD FIN", now granted as U.S. Pat. No. 8,556,670; which claims priority under 35 U.S.C. §119 to U.S. Provisional Application Ser. No. 61/373,777, filed Aug. 13, 2010, entitled "SLIDABLE SURFBOARD FIN". The disclosures of the above-referenced applications are incorporated herein by reference in their entirety.

BACKGROUND

The present invention relates to a surfboard fin, and more particularly to a fin that has one or more articulation points that enable a rider to change the shape and performance characteristics of the fin on-the-fly.

Fins are an essential component of a surfboard. Fins provide directionality and stability, yet enable a rider to turn easily. Surfboard fins come in many shapes and sizes, thicknesses and angles. Fins can be removable or "glass-on" i.e., built in with the surfboard during application of an outer glassy layer. Removable fins enable a rider to remove and replace a fin system on a board with another fin system. However, many riders will not change out even these removable fins, because doing so is relatively time consuming and difficult, and riders instead will stay with the fin system currently attached to their boards.

SUMMARY

This document presents a sliding fin for a watercraft, such as a surfboard. In one aspect, a sliding fin for a surfboard includes a base having a planar tab with an upper flange, a large fin piece having a first indentation, and a small fin piece for mating face-to-face with the large fin piece. The second fin piece has a second indentation that forms a channel that has a cross-sectional shape corresponding to a cross-sectional shape of the planar tab and upper flange, the channel being longer than the width of the planar tab, the small fin piece being translucent to enable the planar tab in the channel to be seen, the large and small fin pieces being slidable relative to the base on the planar tab.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a sliding fin for a watercraft. The fin is configured to "slide" forward and backward into one of a number of forward and back positions relative to a base, so that a surfer can adjust the fin even while they are in the water, on-the-fly.

Figure 1:
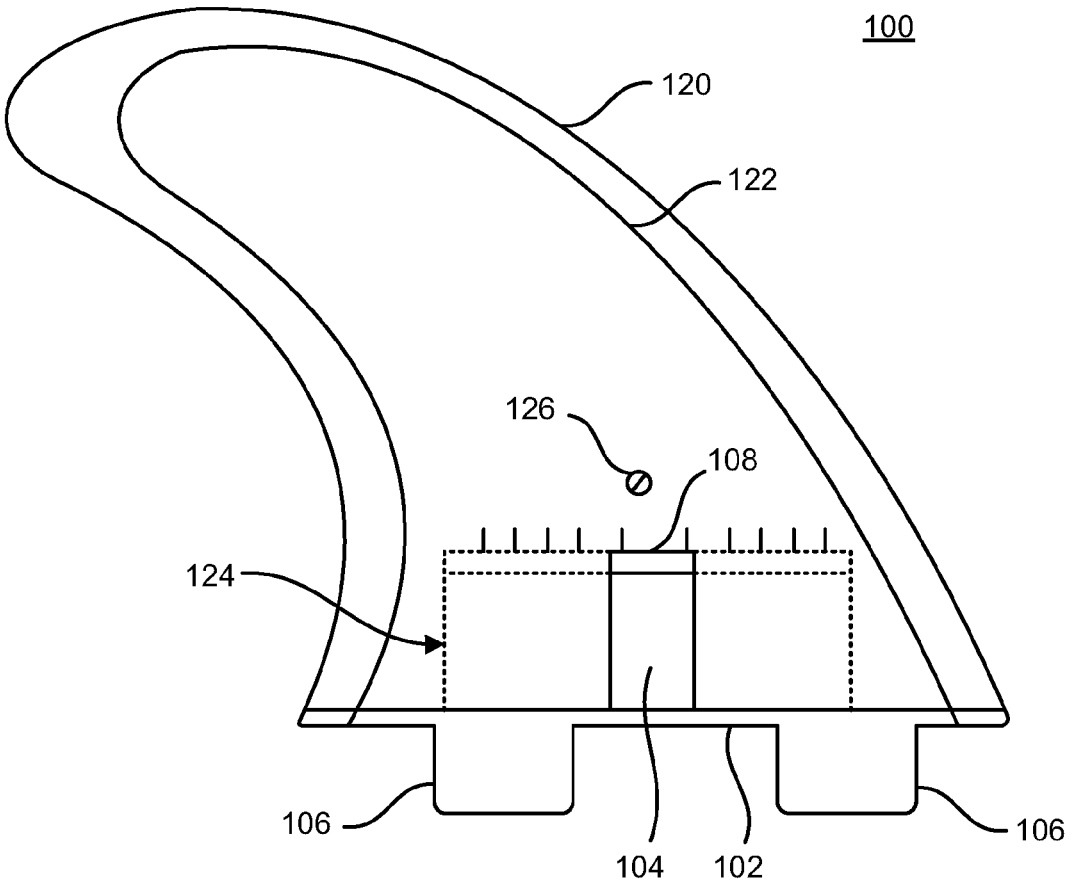
FIG. 1 is a side view that illustrates a sliding fin.
Figure 3:
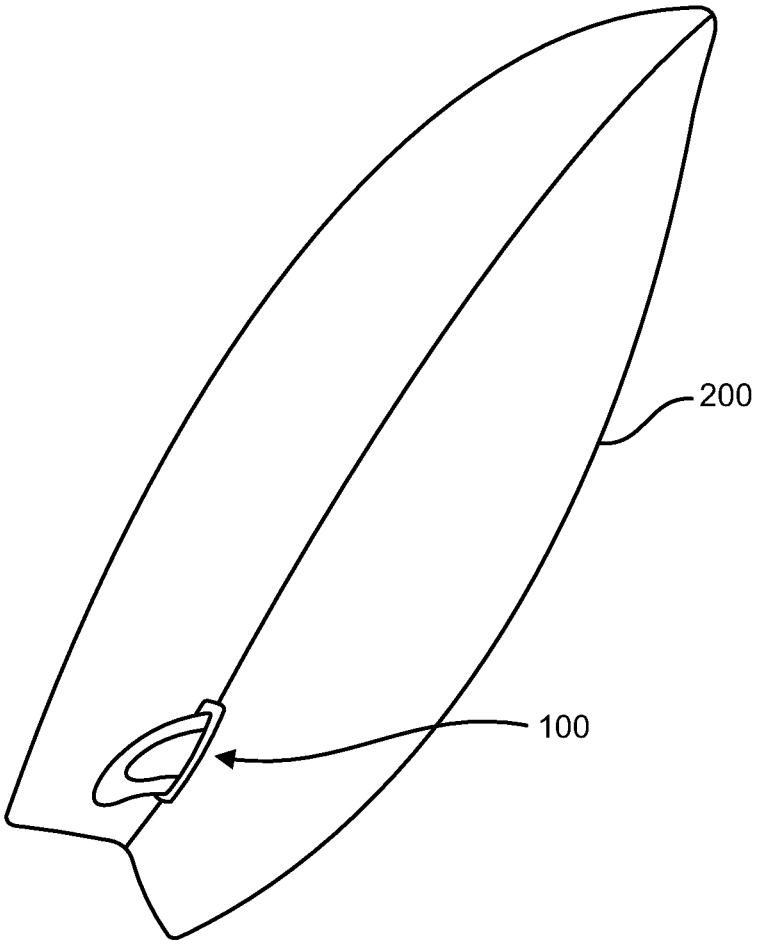
FIG. 3 shows a surfboard having a sliding fin.

As shown in FIG. 1, the sliding fin assembly 100 includes a base 102 with a tab 104 that protrudes upward from the base 102. The base 102 includes one or more protrusions 106 that extend downward from the base 102 for being slotted into or otherwise immovably engaging with a channel in a surfboard 200, shown in FIG. 3, such as like a standard surfboard fin. The tab 104 is preferably planar except for a flange 108 or lip on the top of the tab 104.

Figure 2A:
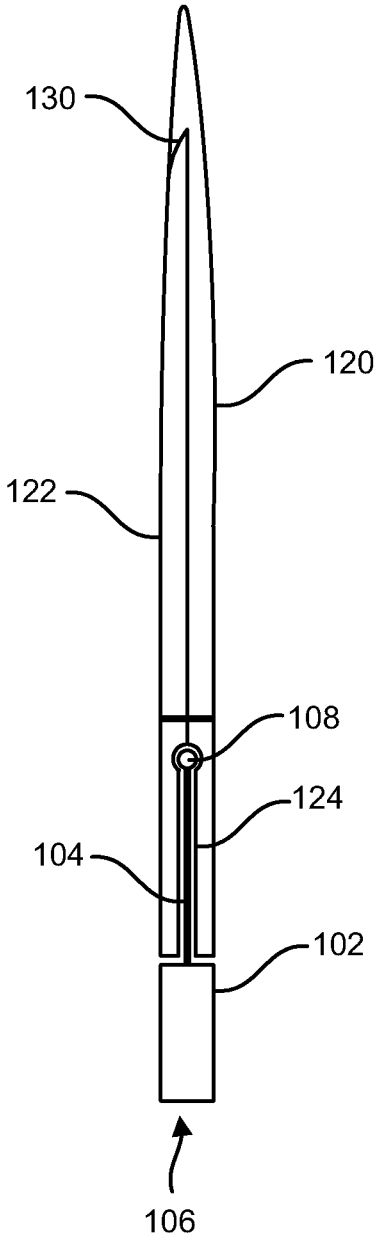
FIG. 2A shows a cut-away view of a sliding fin.
Figure 2B:
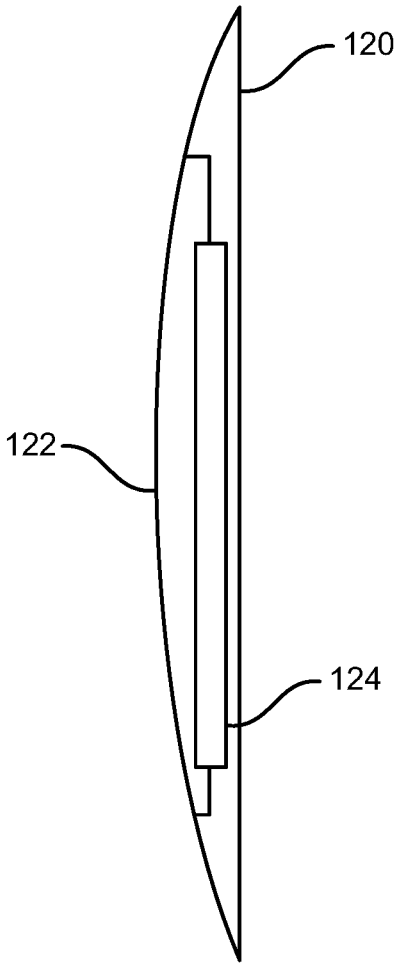
FIG. 2B shows a bottom view of a sliding fin.

With reference also to FIGS. 2A and 2B, the sliding fin assembly 100 further includes a large fin piece 120 and a small fin piece 122 that are mated in juxtaposition to form a shape of any standard surfboard fin. The large fin piece 120 may include one or more overhangs 130 to ensure a snug lock and near seamless fit with the small fin piece 122 when they are mated together. When mated, the small fin piece 122 and large fin piece 120 form a solid fin except for an inner channel 124 that has a cross-sectional shape that corresponds to the shape of the tab 104, with clearance, to receive the tab 104 and allow the tab 104 to slide along the inner channel 124, as shown in FIGS. 1 and 2.

The small fin piece 122 and the large fin piece 120 are planar and curved to form a fin. The small fin piece 122 is preferably clear or translucent, so as to allow the tab 104 in the channel 124 to be seen through the small fin piece 122. Numerical or graduated settings can be etched or printed on the small fin piece 122 or on an inside surface of the large fin piece 120. Accordingly, the fin can be slid and adjusted backward and forward relative to the base 102 to a desired position, and then locked down into that desired position, without the need for complicated adjustments or even leaving the water. The position of the sliding fin assembly 100 can be locked into place by a screw 126 or other locking mechanism.

The large fin piece 120 and the small fin piece 122 can be made of any suitable hard or semi-hard material, including fiberglass, glass, carbon fiber, aluminum, nylon, plastic or hard rubber, and may be formed in different sizes. Additionally, the large fin piece 120 only may be formed with a larger outer profile, to be compatible with a common small fin piece 122 and base 102.

Although a few embodiments have been described in detail above, other modifications are possible. Other embodiments may be within the scope of the following claims.

What is claimed is:

1. An adjustable fin for a surfboard, the adjustable fin comprising:

a base having a tab with an upper flange;

a first fin piece having a first indentation;

a second fin piece slidably mated face-to-face with the first fin piece and having a second indentation that, with the first indentation of the first fin piece, forms a channel that has a cross-sectional shape corresponding to a cross-sectional shape of the tab and upper flange, the channel being longer than the width of the tab, the second fin piece being translucent to enable the tab in the channel to be seen, the first and second fin pieces further being slidable relative to the base on the tab.

2. The adjustable fin in accordance with claim 1, wherein the second fin piece is clear.

3. The adjustable fin in accordance with claim 2, further comprising a set of gradation marks on an inner surface of the first fin piece facing the second fin piece.

4. The adjustable fin in accordance with claim 1, wherein the base further includes one or more protrusions extending down from the base to mate with the surfboard.

5. The adjustable fin in accordance with claim 1, wherein the first fin piece includes one or more overhangs to lock the second fin piece into mated juxtaposition with the first fin piece.

6. The adjustable fin in accordance with claim 1, wherein the second fin piece is smaller than the first fin piece.

7. A surfboard comprising:

a board having a top riding surface and a bottom surface;

a base having a tab with an upper flange, and having one or more protrusions extending below the base to mate with the bottom surface of the board;

a first fin piece having a first indentation;

a second fin piece slidably mated face-to-face with the first fin piece and having a second indentation that, with the first indentation of the first fin piece, forms a channel that has a cross-sectional shape corresponding to a cross-sectional shape of the tab and upper flange, the channel being longer than the width of the planar tab, the second fin piece being translucent to enable the tab in the channel to be seen, the first and second fin pieces further being slidable relative to the base on the tab.

8. The surfboard in accordance with claim 7, wherein the second fin piece is clear.

9. The surfboard in accordance with claim 8, further comprising a set of gradation marks on an inner surface of the first fin piece facing the second fin piece.

10. The surfboard in accordance with claim 7, wherein the first fin piece includes one or more overhangs to lock the second fin piece into mated juxtaposition with the first fin piece.

11. The surfboard in accordance with claim 7, wherein the second fin piece is smaller than the first fin piece.

* * * * *